US006177882B1

(12) United States Patent
Ringgenberg et al.

(10) Patent No.: US 6,177,882 B1
(45) **Date of Patent: *Jan. 23, 2001**

(54) ELECTROMAGNETIC-TO-ACOUSTIC AND ACOUSTIC-TO-ELECTROMAGNETIC REPEATERS AND METHODS FOR USE OF SAME

(75) Inventors: Paul Ringgenberg, Carrollton; Harrison C. Smith, Anna, both of TX (US)

(73) Assignee: Halliburton Energy Services, Inc., Dallas, TX (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/980,597

(22) Filed: Dec. 1, 1997

(51) Int. Cl.[7] ..... G01V 3/00

(52) U.S. Cl. ..... 340/853.7; 367/81; 367/134; 324/342

(58) Field of Search ..... 340/853.7, 853.3, 340/856.4; 367/81, 82, 134; 324/342

(56) References Cited

U.S. PATENT DOCUMENTS

| | | | | |
|---|---|---|---|---|
| 2,379,800 | * | 7/1945 | Hare | 175/356 |
| 2,411,696 | * | 11/1946 | Silverman et al. | 177/352 |
| 3,186,222 | * | 6/1965 | Martin | 73/151 |
| 3,205,477 | | 9/1965 | Kalbfell | 340/18 |
| 3,227,228 | * | 1/1966 | Bannister | 175/4 |
| 3,233,674 | * | 2/1966 | Leutwyler | 166/63 |
| 3,333,239 | * | 7/1967 | Silverman | 340/18 |
| 3,930,220 | | 12/1975 | Shawhan | 340/18 FM |
| 4,019,148 | * | 4/1977 | Shawhan | 328/167 |
| 4,087,781 | | 5/1978 | Grossi et al. | 340/18 NC |
| 4,181,014 | | 1/1980 | Zuvela et al. | 73/151 |
| 4,215,426 | | 7/1980 | Klatt | 367/83 |
| 4,283,780 | * | 8/1981 | Nardi | 367/82 |
| 4,293,936 | * | 10/1981 | Cox et al. | 367/82 |
| 4,293,937 | * | 10/1981 | Sharp et al. | 367/82 |
| 4,298,970 | | 11/1981 | Shawhan et al. | 367/82 |
| 4,302,757 | * | 11/1981 | Still | 340/854 |
| 4,320,473 | | 3/1982 | Smither et al. | 367/82 |
| 4,348,672 | * | 9/1982 | Givier | 340/854 |
| 4,363,137 | | 12/1982 | Salisbury | 455/40 |
| 4,373,582 | * | 2/1983 | Bednar et al. | 166/65 R |
| 4,387,372 | * | 6/1983 | Smith et al. | 340/854 |
| 4,406,919 | | 9/1983 | Pospischil | 178/69 G |
| 4,468,665 | * | 8/1984 | Thawley et al. | 340/856 |
| 4,496,174 | * | 1/1985 | McDonald et al. | 285/53 |
| 4,525,715 | * | 6/1985 | Smith | 340/854 |
| 4,562,559 | | 12/1985 | Sharp et al. | 367/82 |
| 4,578,675 | * | 3/1986 | Macleod | 340/855 |
| 4,616,702 | | 10/1986 | Hanson et al. | 166/65.1 |
| 4,617,960 | * | 10/1986 | More | 137/554 |
| 4,684,946 | * | 8/1987 | Issenmann | 340/855 |

(List continued on next page.)

FOREIGN PATENT DOCUMENTS

| | | |
|---|---|---|
| 2 281 424 | 1/1996 | (GB) . |
| 0 672 819 A2 | 9/1995 | (NO) . |

* cited by examiner

*Primary Examiner*—Michael Horabik
*Assistant Examiner*—Timothy Edwards, Jr.
(74) *Attorney, Agent, or Firm*—Paul I. Herman; Lawrence R. Youst

(57) ABSTRACT

A downhole communications system including an electromagnetic-to-acoustic signal repeater (35) for communicating information between surface equipment and downhole equipment and a method for use of the repeater (35) is disclosed. The repeater (35) comprises an electromagnetic receiver (37) and an acoustic transmitter (41). The receiver (37) receives an electromagnetic input signal and transforms the electromagnetic input signal to an electrical signal that is inputted into an electronics package (39) that amplifies the electrical signal and forwards the electrical signal to the transmitter (41) that transforms the electrical signal to an acoustic output signal that is acoustically transmitted.

20 Claims, 9 Drawing Sheets

U.S. PATENT DOCUMENTS

| | | | | |
|---|---|---|---|---|
| 4,691,203 | * | 9/1987 | Rubin et al. | 340/856 |
| 4,725,837 | * | 2/1988 | Rubin | 340/855 |
| 4,739,325 | * | 4/1988 | Macleod | 340/854 |
| 4,757,157 | | 7/1988 | Pelet | 174/50 |
| 4,766,442 | | 8/1988 | Issenmann | 343/719 |
| 4,788,544 | | 11/1988 | Howard | 340/853 |
| 4,800,570 | | 1/1989 | Perrotta et al. | 375/4 |
| 4,839,644 | * | 6/1989 | Safinya et al. | 340/854 |
| 4,845,493 | * | 7/1989 | Howard | 340/853 |
| 4,901,069 | * | 2/1990 | Veneruso | 340/853 |
| 4,908,804 | | 3/1990 | Rorden | 367/81 |
| 4,933,640 | * | 6/1990 | Kuckes | 324/339 |
| 4,968,978 | | 11/1990 | Stolarczyk | 340/854 |
| 5,087,099 | | 2/1992 | Stolarczyk | 299/1 |
| 5,130,706 | * | 7/1992 | Van Steenwyk | 340/854.6 |
| 5,160,925 | | 11/1992 | Dailey et al. | 340/853.3 |
| 5,268,683 | | 12/1993 | Stolarczyk | 340/854.4 |
| 5,390,748 | * | 2/1995 | Goldman | 175/24 |
| 5,394,141 | * | 2/1995 | Soulier | 340/854.4 |
| 5,396,232 | * | 3/1995 | Mathieu et al. | 340/854.5 |
| 5,448,227 | * | 9/1995 | Orban et al. | 340/854.4 |
| 5,467,083 | * | 11/1995 | McDonald et al. | 340/854.6 |
| 5,467,832 | * | 11/1995 | Orban et al. | 175/45 |
| 5,493,288 | | 2/1996 | Henneuse | 340/854.4 |
| 5,530,358 | | 6/1996 | Wisler et al. | 324/338 |
| 5,576,703 | | 11/1996 | MacLeod et al. | 340/854.4 |
| 5,583,504 | | 12/1996 | Huggett | 342/15 |
| 5,691,712 | * | 11/1997 | Meek et al. | 334/853.3 |
| 5,914,911 | | 6/1999 | Babour et al. | 367/82 |
| 6,018,501 | * | 1/2000 | Smith et al. | 367/81- |

ELECTROMAGNETIC-TO-ACOUSTIC AND ACOUSTIC-TO-ELECTROMAGNETIC REPEATERS AND METHODS FOR USE OF SAME

TECHNICAL FIELD OF THE INVENTION

The present invention relates in general to downhole telemetry and in particular to the use of electromagnetic-to-acoustic and acoustic-to-electromagnetic signal repeaters for communicating information between downhole equipment and surface equipment.

BACKGROUND OF THE INVENTION

Without limiting the scope of the present invention, its background will be described with reference to transmitting downhole data to the surface during a measurement while drilling ("MWD") operation. The principles of the present invention, however, are applicable not only during the drilling process, but throughout the utilization of the fluid or gas extraction well including, but not limited to, logging, testing, completing and producing the well.

In the past, a variety of communication and transmission techniques have been attempted in order to provide real time data from the vicinity of the drill bit to the surface during the drilling operation or during the production process. The utilization of Measurement While Drilling ("MWD") with real time data transmission provides substantial benefits during a drilling operation that enable increased control of the process. For example, continuous monitoring of downhole conditions allows for a timely response to possible well control problems and improves operational response to problems and potential problems as well as optimization of controllable drilling and production parameters during the drilling and operation phases.

Measurement of parameters such as bit weight, torque, wear and bearing condition on a real time basis provides the means for a more efficient drilling operation. Increased drilling rates, better trip planning, reduced equipment failures, fewer delays for directional surveys, and the elimination of the need to interrupt drilling operations for abnormal pressure detection are achievable using MWD techniques.

At present, there are four categories of telemetry systems have been utilized in attempts to provide real time data from the vicinity of the drill bit to the drilling platform or to the facility controlling the drilling and production operation. These techniques include mud pressure pulses, insulated conductors, acoustics and electromagnetic waves.

In a mud pressure pulse transmission system, resistance of mud flow through a drill string is modulated by means of a valve and control mechanism mounted in a specially adapted drill collar near the bit. Pressure Pulse transmission mechanisms are relatively slow in terms of data transmission of measurements due to pulse spreading, modulation rate limitations, and other disruptive limitations such as the requirement of mud flow. Generally, pressure pulse transmission systems are is normally limited to transmission rates of 1 to 2 bits per second.

Alternatively, insulated conductors, or hard wire connections from the bit to the surface, provide a method for establishing downhole communications. These systems may be capable of a high data rate and, in addition, provide for the possibility of two way communication. However insulated conductors and hard wired systems require a especially adapted drill pipe and special tool joint connectors which substantially increase the cost of monitoring a drilling or production operation. Furthermore, insulated conductor and hard wired systems are prone to failure as a result of the severe down-hole environmental conditions such as the abrasive conditions of the mud system, extreme temperatures, high pressures and the wear caused by the rotation of the drill string.

Acoustic systems present a third potential means of data transmission. An acoustic signal generated near the bit, or particular location of interest, is transmitted through the drill pipe, mud column or the earth. However, due to downhole space and environmental constraints, the low intensity of the signal which can be generated downhole, along with the acoustic noise generated by the drilling system, makes signal transmission and detection difficult over long distances. In the case where the drill string is utilized as the primary transmission medium, reflective and refractive interferences resulting from changing diameters and the geometry of the connections at the tool and pipe joints, compound signal distortion and detection problems when attempts are made to transmit a signal over long distances.

The fourth technique used to telemeter downhole data to surface detection and recording devices utilizes electromagnetic ("EM") waves. A signal carrying downhole data is input to a toroid or collar positioned adjacent to the drill bit or input directly to the drill string. When a toroid is utilized, a primary winding, carrying the data for transmission, is wrapped around the toroid and a secondary is formed by the drill pipe. A receiver is connected to the ground at the surface where the electromagnetic data is picked up and recorded. However, in deep or noisy well applications, conventional electromagnetic systems are often unable to generate a signal with sufficient intensity and clarity to reach the desired reception location with sufficient strength for accurate reception. Additionally, in certain applications where the wellbore penetrates particular strata, for example, a high salt concentration, transmission of data via EM over any practical distance is difficult or impossible due to ground and electrochemical effects.

Thus, there is a need for a downhole communication and data transmission system that is capable of transmitting data between a surface location and equipment located in the vicinity of the drill bit, or another selected location in the wellbore. A need has also arisen for such a communication system that is capable of operation in a deep or noisy well or in a wellbore penetrating formations that preclude or interfere with the use of known techniques for communication.

SUMMARY OF THE INVENTION

The present invention disclosed herein comprises downhole repeaters that utilizes electromagnetic and acoustic waves to retransmit signals carrying information and the methods for use of the same. The repeaters and methods of the present invention provide for real time communication between downhole equipment and the surface and for the telemetering of information and commands from the surface to downhole tools disposed in a well using both electromagnetic and acoustic waves to carry information. The repeaters and methods of the present invention serve to detect and amplify the signals carrying information at various depths in the wellbore, thereby alleviating signal attenuation.

In one embodiment, a repeater of the present invention comprises an electromagnetic receiver for receiving an electromagnetic input signal and transforming the electromagnetic input signal to an electrical signal, an electronics package for processing the electrical signal and an acoustic transmitter for transforming the electrical signal to an acoustic output signal. In another embodiment, a repeater of the present invention comprises an acoustic receiver for receiving an acoustic input signal and transforming the acoustic input signal to an electrical signal, an electronics package for processing the electrical signal and an electromagnetic transmitter for transforming the electrical signal to an electromagnetic output signal.

The electromagnetic receivers and transmitters of each of the embodiments may comprise a magnetically permeable annular core, a plurality of primary electrical conductor windings wrapped axially around the annular core and a plurality of secondary electrical conductor windings wrapped axially around the annular core and magnetically coupled to the plurality of primary electrical conductor windings. Alternatively, the electromagnetic transmitters may comprise a pair of electrically isolated terminals each of which are electrically connected to the electronics package.

The acoustic receivers and transmitters of each of the embodiments may comprise a plurality of piezoelectric elements. The electronics package may include an annular carrier having a plurality of axial openings for receiving a battery pack and an electronics member having a plurality of electronic devices thereon for processing and amplifying the electrical signals.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1A:
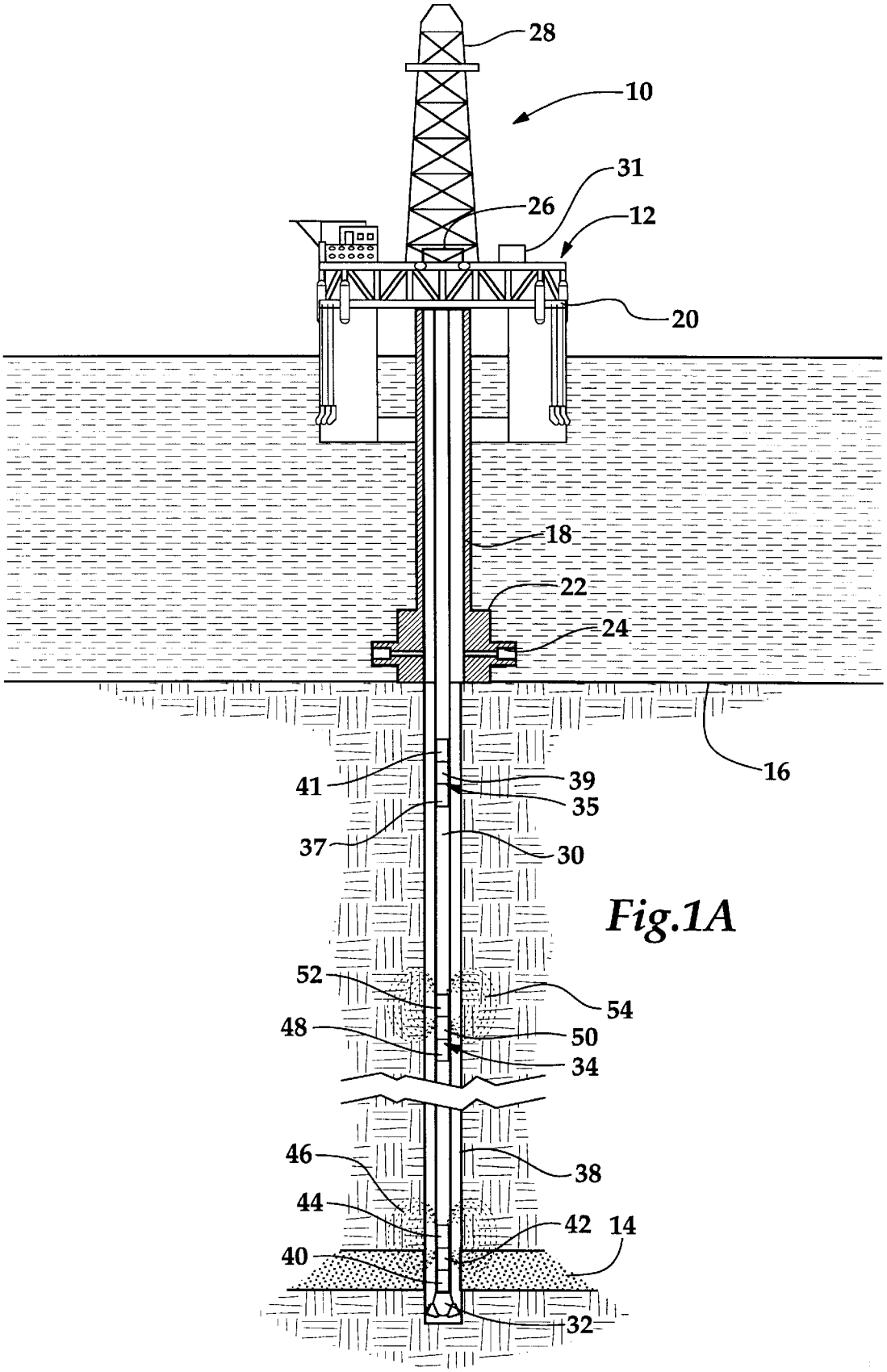
FIG. 1A is a schematic illustration of a telemetry system operating an electromagnetic-to-acoustic signal repeater the present invention.

Referring now to FIG. 1A, a communication system including an electromagnetic signal generator, an electromagnetic signal repeater and an electromagnetic-to-acoustic repeater in use on an offshore oil and gas drilling platform is schematically illustrated and generally designated 10. A semi-submergible platform 12 is centered over a submerged oil and gas formation 14 located below sea floor 16. A subsea conduit 18 extends from deck 20 of platform 12 to wellhead installation 22 including blowout preventers 24. Platform 12 has a derrick 26 and a hoisting apparatus 28 for raising and lowering drill string 30, including drill bit 32, electromagnetic signal repeater 34 and electromagnetic-to-acoustic signal repeater 35.

In a typical drilling operation, drill bit 32 is rotated by drill string 30, such that drill bit 32 penetrates through the various earth strata, forming wellbore 38. Measurement of parameters such as bit weight, torque, wear and bearing conditions may be obtained by sensors 40 located in the vicinity of drill bit 32. Additionally, parameters such as pressure and temperature as well as a variety of other environmental and formation information may be obtained by sensors 40. The signal generated by sensors 40 may typically be analog, which must be converted to digital data before electromagnetic transmission in the present system. The signal generated by sensors 40 is passed into an electronics package 42 including an analog to digital converter which converts the analog signal to a digital code utilizing "1" and "0" for information transmission.

Electronics package 42 may also include electronic devices such as an on/off control, a modulator, a microprocessor, memory and amplifiers. Electronics package 42 is powered by a battery pack which may include a plurality of batteries, such as nickel cadmium or lithium batteries, which are configured to provide proper operating voltage and current.

Once the electronics package 42 establishes the frequency, power and phase output of the information, electronics package 42 feeds the information to transmitter 44. Transmitter 44 may be a direct connect to drill string 30 or may electrically approximate a large transformer. The information is then carried uphole in the form of electromagnetic wave fronts 46 which travel through the earth. These electromagnetic wave fronts 46 are picked up by a receiver 48 of repeater 34 located uphole from transmitter 44.

Receiver 48 of repeater 34 is spaced along drill string 30 to receive the electromagnetic wave fronts 46 while electromagnetic wave fronts 46 remain strong enough to be readily detected. Receiver 48 may electrically approximate a large transformer. As electromagnetic wave fronts 46 reach receiver 48, a current is induced in receiver 48 that carries the information originally obtained by sensors 40. The current is fed to an electronics package 50 that may include a variety of electronic devices such as a preamplifier, a limiter, a plurality of filters, a frequency to voltage converter, a voltage to frequency converter and amplifiers as will be further discussed with reference to FIGS. 9 and 11. Electronics package 50 cleans up and amplifies the signal to reconstruct the original waveform, compensating for losses and distortion occurring during the transmission of electromagnetic wave fronts 46 through the earth.

Electronics package 50 is coupled to a transmitter 52 that radiates electromagnetic wave fronts 54 in the manner described with reference to transmitter 44 and electromagnetic wave fronts 46. Electromagnetic wave fronts 54 travel through the earth and are received by electromagnetic-to-acoustic repeater 35 that may be located near sea floor 16 on drill string 30. The electromagnetic-to-acoustic repeater 35 includes a receiver 37, electronics package 39 and acoustic transmitter 41. The receiver 37 detects electromagnetic wave fronts 46 and serves as a transducer, transforming electromagnetic wave fronts 54 into an electrical signal. The electrical signal is transmitted to electronics package 39 that may include a variety of electronic devices such as a preamplifier, a limiter, a plurality of filters, a frequency to voltage converter, a voltage to frequency converter and amplifiers as will be further discussed with reference to FIGS. 9 and 11. The electronics package 39, in turn, provides a signal to acoustic transmitter 41 which generates an acoustic signal that is transmitted via the drill string 30 to an acoustic receiver 31 mounted on, or adjacent to, platform 12. Upon reaching platform 12, the information originally obtained by sensors 40 is further processed making any necessary calculations and error corrections such that the information may be displayed in a usable format. Alternatively, the acoustic signal may be transmitted through the fluid in the annulus around drill string 30 and received in the moon pool of platform 12.

Even though FIG. 1A depicts two repeaters 34 and 35, it should be noted by one skilled in the art that the number of repeaters located within drill string 30 will be determined by the depth of wellbore 38, the noise level in wellbore 38 and the characteristics of the earth's strata adjacent to wellbore 38 in that electromagnetic and acoustic waves suffer from attenuation with increasing distance from their source at a rate that is dependent upon the composition characteristics of the transmission medium and the frequency of transmission. For example, electromagnetic signal repeaters, such as electromagnetic signal repeater 34, may be positioned between 3,000 and 5,000 feet apart. Thus, if wellbore 38 is 15,000 feet deep, between two and four electromagnetic signal repeaters such as electromagnetic signal repeater 34 may be desirable.

Additionally, as will be apparent to those skilled in the art, the system illustrated in FIG. 1A is particularly applicable in the case of an offshore well in deep water. Specifically, electromagnetic-to-acoustic repeater 35 is used to overcome the difficulty of transmitting electromagnetic waves through sea water. In fact, the use of an EM system alone requires the placement of one or more specialized ocean floor receivers to detect the electromagnetic signal from a downhole transmitter or repeater. Placement of such devices typically requires the use of a remotely operated vehicle (ROV) or similar device. Use of the above-described embodiment of the present invention avoids the costs inherent in this procedure.

Additionally, while FIG. 1A has been described with reference to transmitting information uphole during a measurement while drilling operation, it should be understood by one skilled in the art that repeaters 34, 35 may be used in conjunction with the transmission of information downhole from surface equipment to downhole tools to perform a variety of functions such as opening and closing a downhole tester valve or controlling a downhole choke.

Further, even though FIG. 1A has been described with reference to one way communication from the vicinity of drill bit 32 to platform 12, it will be understood by one skilled in the art that the principles of the present invention are applicable to two way communication. For example, a surface installation may be used to request downhole pressure, temperature, or flow rate information from formation 14 by sending acoustic or electromagnetic signals downhole which would again be amplified as described above with reference to repeaters 34, 35. Sensors, such as sensors 40, located near formation 14 receive this request and obtain the appropriate information which would then be returned to the surface via electromagnetic wave fronts which would again be amplified and transmitted electromagnetically as described above with reference to repeater 34 and acoustically as described above with reference to repeater 35. As such, the phrase "between surface equipment and downhole equipment" as used herein encompasses the transmission of information from surface equipment downhole, from downhole equipment uphole, or for two way communication.

Whether the information is being sent from the surface to a downhole destination or a downhole location to the surface, electromagnetic wave fronts and acoustic signals may be radiated at varying frequencies such that the appropriate receiving device or devices detect that the signal is intended for the particular device. Additionally, repeaters 34 and 35 may include blocking switches which prevents the receivers from receiving signals while the associated transmitters are transmitting.

Figure 1B:
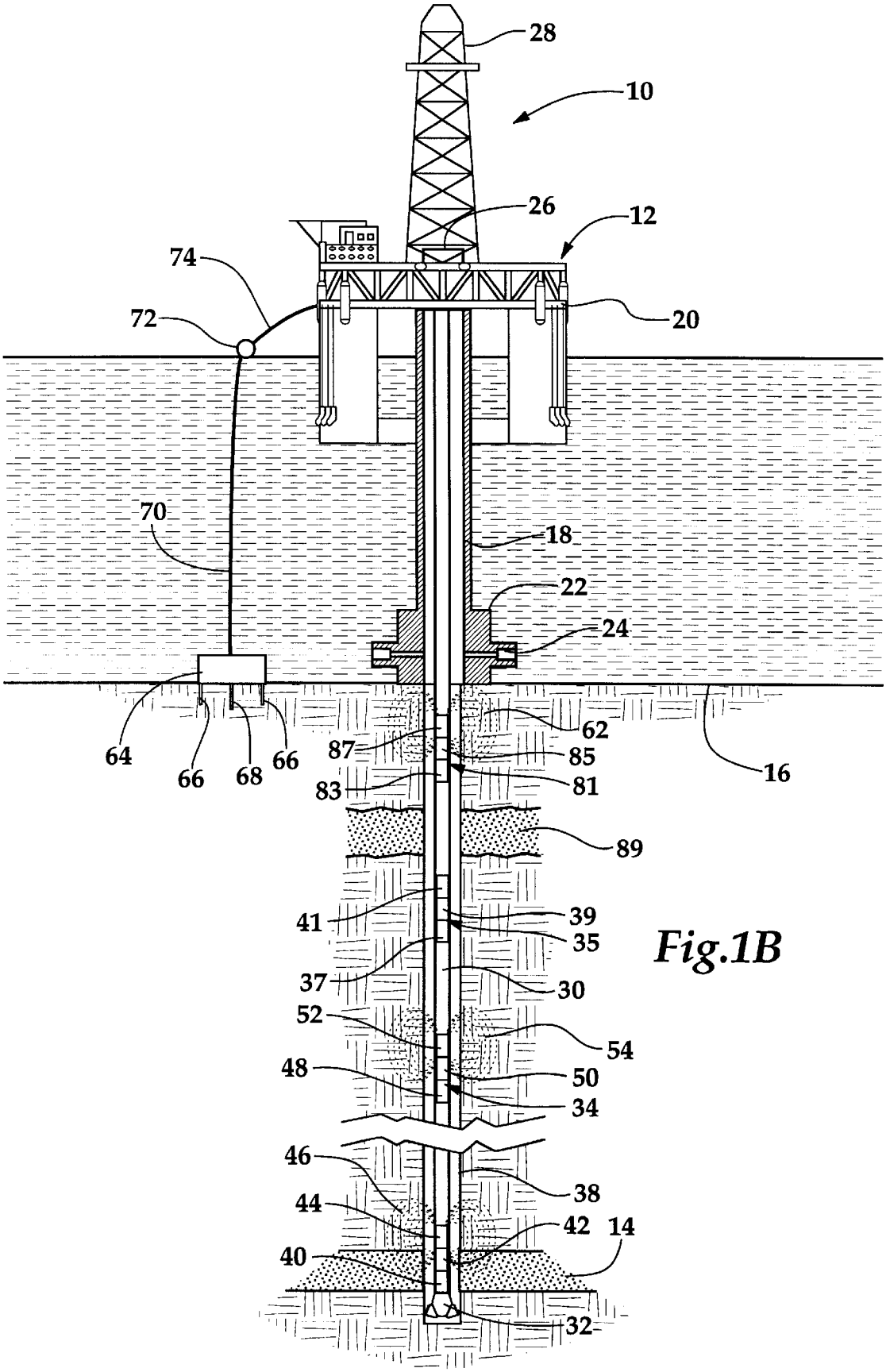
FIG. 1B is a schematic illustration of a telemetry system operating an electromagnetic-to-acoustic signal repeater and an acoustic-to-electromagnetic signal repeater of the present invention.

Referring now to FIG. 1B, another embodiment of the present invention is represented. As described with reference to FIG. 1A, information is collected by sensors 40, processed in electronics package 42 and electromagnetically transmitted by transmitter 44 as electromagnetic wave fronts 46 which are picked up by receiver 48 of repeater 34. Repeater 34 amplifies the signal in electronics package 50 and electromagnetically transmits the signal using transmitter 52 as electromagnetic wave fronts 54. In the embodiment illustrated in FIG. 1B, wellbore 38 passes through a highly conductive medium such as salt layer 89. EM transmission through such highly conductive strata is typically hindered to the point that communication via electromagnetic transmission is rendered impractically or impossible.

In order to overcome the difficulties encountered with EM transmission through salt layer 89, electromagnetic-to-acoustic repeater 35 is positioned at a predetermined location downhole of the layer 89. Electromagnetic wave fronts 54 are received by receiver 37 of electromagnetic-to-acoustic repeater 35. Receiver 37 transforms electromagnetic wave fronts 54 into an electrical signal that is transmitted to electronics package 39 for processing and amplification. The electronics package 39, in turn, provides a signal to acoustic transmitter 41 which generates an acoustic signal that is transmitted via the drill string. Acoustic transmitter 41 may comprise a transducer in the form of a stack of ceramic crystals which will be further described with reference to FIG. 4. The acoustic signal travels, unimpeded by the highly conductive layer 89, through the drill string 30 to an acoustic-to-electromagnetic repeater 81.

Acoustic-to-electromagnetic repeater 81 includes a receiver 83, an electronics package 85 and a transmitter 87.

Receiver 83 of repeater 81 is positioned to receive the acoustic signals transmitted through conductive layer 89 at a point where the acoustic signals are of a magnitude sufficient for adequate reception. Receiver 83 may comprise a transducer in the form of a stack of ceramic crystals as described in greater detail with reference to FIG. 4. As signals reach receiver 83, the signal is converted to an electrical current which represents the information originally obtained by sensors 40. The current is fed to an electronics package 85 for processing and amplification to reconstruct the original waveform, compensating for losses and distortion occurring during the transmission of the acoustic signal.

Electronics package 85 is coupled to a transmitter 87 that radiates electromagnetic wave fronts 62 in the manner described with reference to transmitter 44 and electromagnetic wave fronts 46. Electromagnetic wave fronts 62 travel through the earth and are received by electromagnetic pickup device 64 located on sea floor 16.

Electromagnetic pickup device 64 may sense either the electric field or the magnetic field of electromagnetic wave fronts 62 using an electric field sensor 66 or a magnetic field sensor 68 or both. The electromagnetic pickup device 64 serves as a transducer transforming electromagnetic wave fronts 62 into an electrical signal using a plurality of electronic devices. The electrical signal may be sent to the surface on wire 70 that is attached to buoy 72 and onto platform 12 for further processing via wire 74. Upon reaching platform 12, the information originally obtained by sensors 40 is further processed making any necessary calculations and error corrections such that the information may be displayed in a usable format.

Even though FIG. 1B has been described with reference to an offshore environment, it should be understood by one skilled in the art that the principles described herein are equally well-suited for an onshore environment. In fact, in an onshore operation, electromagnetic pickup device 64 would be placed directly on the land surface.

Alternatively, it should be noted that transmitter 87 may be an acoustic transmitter. In this case, the information received from sensors 40 will be transmitted to platform 12 in the form of an acoustic signal as heretofore described in connection with FIG. 1A.

As will be appreciated by those skilled in the art, the above-described embodiment of the invention provides for the transmission of data across a highly conductive layer 89 by "jumping" across layer 89 with an acoustic signal. Thus, use of this embodiment of the invention allows for EM data transmission over a substantial portion of wellbore 38 while simultaneously overcoming the difficulties involved in EM transmission across highly conductive layers.

Figure 1C:
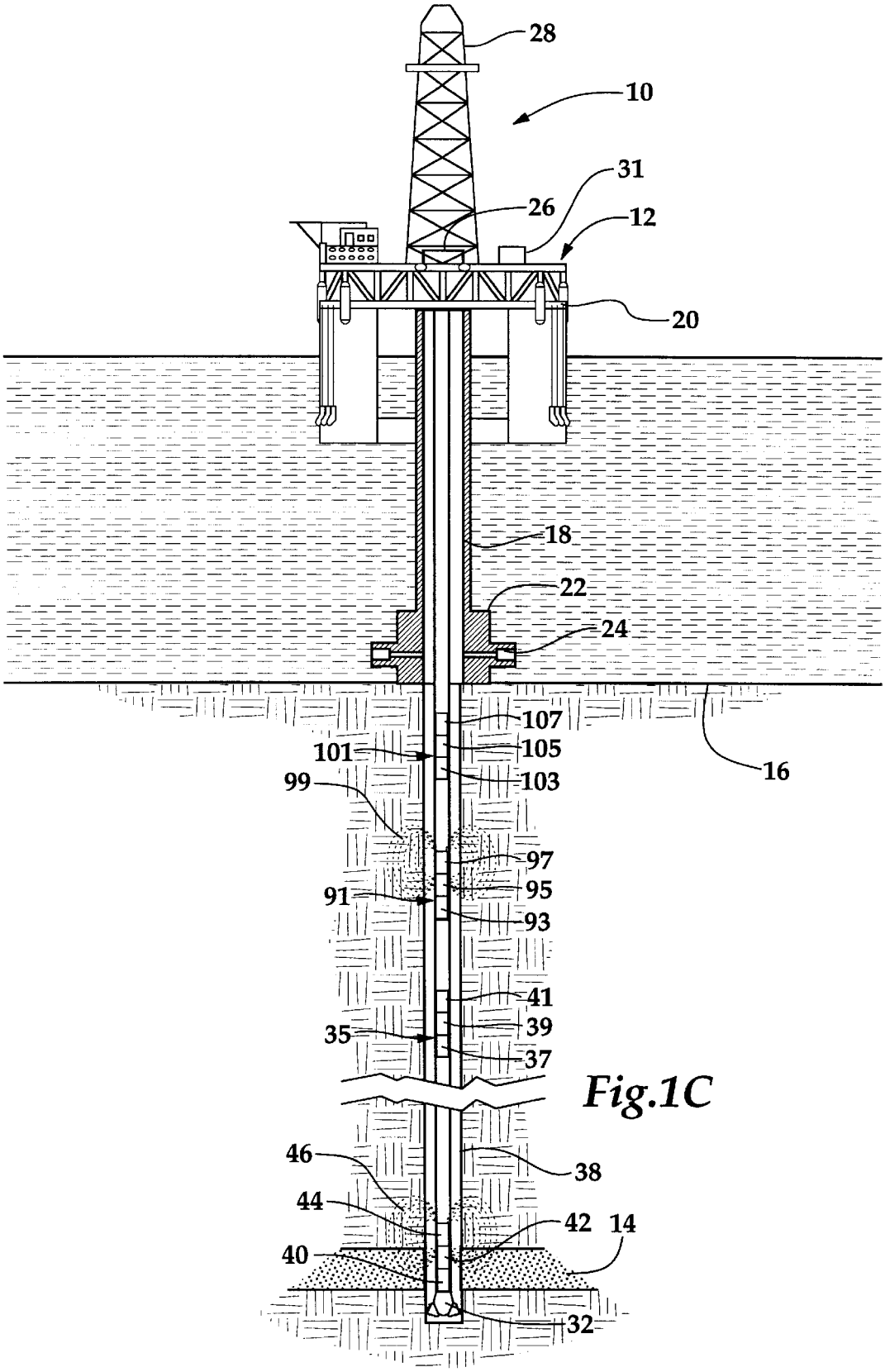
FIG. 1C is a schematic illustration of a telemetry system operating an electromagnetic-to-acoustic signal repeater and an acoustic-to-electromagnetic signal repeater of the present invention.

Turning now to FIG. 1C, a system of alternating electromagnetic-to-acoustic and acoustic-to-electromagnetic repeaters are depicted. This system is utilized to increase data transmission rates as compared to conventional EM or acoustic systems alone. As described above, information is collected by sensors 40, processed by electronics package 42 and transmitted via transmitter 44. Electromagnetic wave fronts 46 travel through the earth and are received by electromagnetic-to-acoustic repeater 35. The electromagnetic-to-acoustic repeater 35 includes a receiver 37, electronics package 39 and acoustic transmitter 41. The receiver 37 serves as a transducer, transforming electromagnetic wave front 46 into an electrical signal that is transmitted to electronics package 39 that may include a variety of electronic devices as previously described. The electronics package 39, in turn, provides an electrical signal to acoustic transmitter 41 which generates an acoustic signal that is transmitted via drill string 30 to an acoustic-to-electromagnetic repeater 91, including a receiver 93, electronics package 95 and transmitter 97. The acoustic signal is received, processed and retransmitted as described above in connection with repeater 35 of FIG. 1B.

The electromagnetic wave fronts 99 generated by transmitter 97 are received by electromagnetic-to-acoustic repeater 101. Electromagnetic-to-acoustic repeater 101 includes receiver 103, electronics package 105 and transmitter 107 that retransmits an acoustic signal to acoustic receiver 31 in the same manner as described in conjunction with repeater 35 of FIG. 1A. Depending upon the depth of wellbore 38, the strata through which the signal is transmitted, the amount of noise inherent in wellbore 38 during drilling or production operations, electromagnetic-to-acoustic and acoustic-to-electromagnetic repeaters 35, 91 and 101 are spaced along drill string 30 at intervals as necessary to obtain the desired transmission characteristics.

The use of a downhole communications system for a deep well requiring multiple repeaters, based solely upon either electromagnetic or acoustic repeaters, requires that each repeater, whether acoustic-to-acoustic or electromagnetic-to-electromagnetic, cease transmission before receiving data and likewise cease reception while transmitting data due to interference between the transmitted and received signals.

Since the repeaters in an a downhole communication system based solely upon acoustic-to-acoustic or electromagnetic-to-electromagnetic transmissions typically do not simultaneously receive and transmit data, transmission of data is inevitably delayed. The above-described embodiment of the invention alleviates this type of delay by alternating electromagnetic-to-acoustic and acoustic-to-electromagnetic repeaters, thereby allowing the repeaters to simultaneously transmit and receive data and increase the overall bit rate.

Figure 2A:
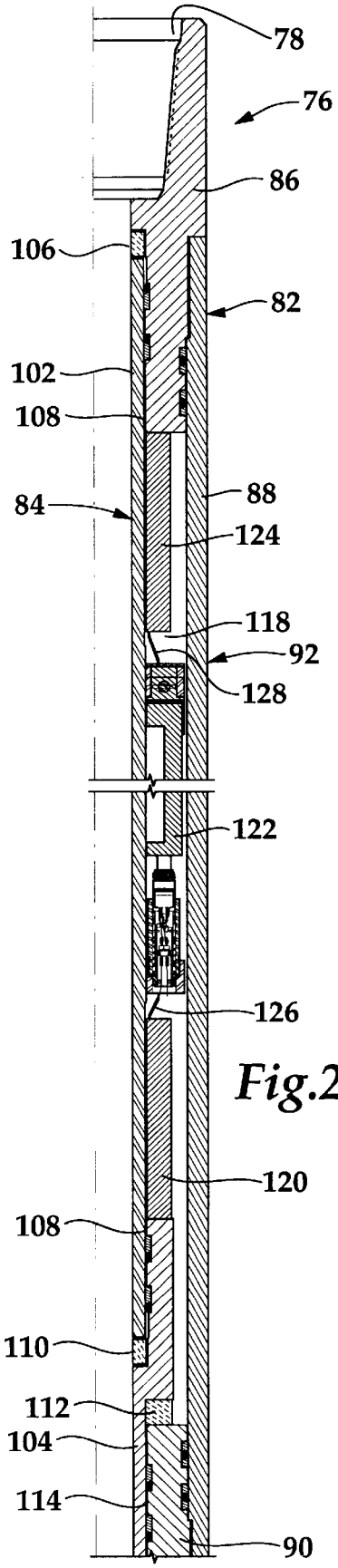
FIGS. 2A–2B are quarter-sectional views of a repeater of the present invention that may operate as an acoustic-to-electromagnetic signal repeater or an electromagnetic-to-acoustic signal repeater.
Figure 2B:
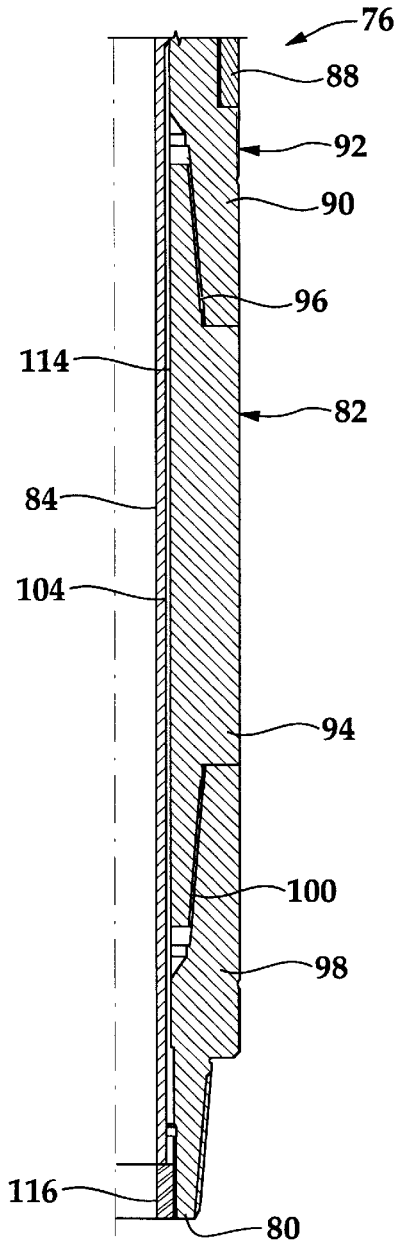

Referring now to FIGS. 2A–2B, one embodiment of a repeater 76 of the present invention is illustrated. For convenience of illustration, repeater 76 is depicted in a quarter sectional view. Repeater 76 has a box end 78 and a pin end 80 such that repeater 76 is threadably adaptable to drill string 30. Repeater 76 has an outer housing 82 and a mandrel 84 having a full bore so that when repeater 76 is interconnected with drill string 30, fluids may be circulated therethrough and therearound. Specifically, during a drilling operation, drilling mud is circulated through drill string 30 inside mandrel 84 of repeater 76 to ports formed through drill bit 32 and up the annulus formed between drill string 30 and wellbore 38 exteriorly of housing 82 of repeater 76. Housing 82 and mandrel 84 thereby protect to operable components of repeater 76 from drilling mud or other fluids disposed within wellbore 38 and within drill string 30.

Housing 82 of repeater 76 includes an axially extending and generally tubular upper connecter 86 which has box end 78 formed therein. Upper connecter 86 may be threadably and sealably connected to drill string 30 for conveyance into wellbore 38.

An axially extending generally tubular intermediate housing member 88 is threadably and sealably connected to upper connecter 86. An axially extending generally tubular lower housing member 90 is threadably and sealably connected to intermediate housing member 88. Collectively, upper connecter 86, intermediate housing member 88 and lower housing member 90 form upper subassembly 92. Upper subassembly 92, including upper connecter 86, intermediate housing member 88 and lower housing member 90, is electrically connected to the section of drill string 30 above repeater 76.

An axially extending generally tubular isolation subassembly 94 is securably and sealably coupled to lower housing member 90. Disposed between isolation subassembly 94 and lower housing member 90 is a dielectric layer 96 that provides electric isolation between lower housing member 90 and isolation subassembly 94. Dielectric layer 96 is composed of a dielectric material, such as aluminum oxide, chosen for its dielectric properties and capably of withstanding compression loads without extruding.

An axially extending generally tubular lower connecter 98 is securably and sealably coupled to isolation subassembly 94. Disposed between lower connecter 98 and isolation subassembly 94 is a dielectric layer 100 that electrically isolates lower connecter 98 from isolation subassembly 94. Lower connecter 98 is adapted to threadably and sealably connect to drill string 30 and is electrically connected to the portion of drill string 30 below repeater 76.

Isolation subassembly 94 provides a discontinuity in the electrical connection between lower connecter 98 and upper subassembly 92 of repeater 76, thereby providing a discontinuity in the electrical connection between the portion of drill string 30 below repeater 76 and the portion of drill string 30 above repeater 76.

It should be apparent to those skilled in the art that the use of directional terms such as above, below, upper, lower, upward, downward, etc. are used in relation to the illustrative embodiments as they are depicted in the figures, the upward direction being towards the top of the corresponding figure and the downward direction being toward the bottom of the corresponding figure. It is to be understood that repeater 76 may be operated in vertical, horizontal, inverted or inclined orientations without deviating from the principles of the present invention.

Mandrel 84 includes axially extending generally tubular upper mandrel section 102 and axially extending generally tubular lower mandrel section 104. Upper mandrel section 102 is partially disposed and sealing configured within upper connecter 86. A dielectric member 106 electrically isolates upper mandrel section 102 from upper connecter 86. The outer surface of upper mandrel section 102 has a dielectric layer disposed thereon. Dielectric layer 108 may be, for example, a teflon layer. Together, dielectric layer 108 and dielectric member 106 serve to electrically isolate upper connecter 86 from upper mandrel section 102.

Between upper mandrel section 102 and lower mandrel section 104 is a dielectric member 110 that, along with dielectric layer 108 serves to electrically isolate upper mandrel section 102 from lower mandrel section 104. Between lower mandrel section 104 and lower housing member 90 is a dielectric member 112. On the outer surface of lower mandrel section 104 is a dielectric layer 114 which, along with dielectric member 112 provide for electric isolation of lower mandrel section 104 from lower housing member 90. Dielectric layer 114 also provides for electric isolation between lower mandrel section 104 and isolation subassembly 94 as well as between lower mandrel section 104 and lower connecter 98. Lower end 116 of lower mandrel section 104 is disposed within lower connecter 98 and is in electrical communication with lower connecter 98. Intermediate housing member 88 of outer housing 82 and upper mandrel section 102 of mandrel 84 define annular area 118. A receiver 120, an electronics package 122 and a transmitter 124 are disposed within annular area 118.

In operation, repeater 76 may, for example, serve as electromagnetic repeater 34 of FIG. 1A, as electromagnetic-to-acoustic repeater 35 of FIG. 1A or as acoustic-to-electromagnetic repeater 81 of FIG. 1B. When repeater 76 serves as electromagnetic repeater 34 of FIG. 1A, receiver 120 receives an electromagnetic input signal carrying information which is transformed into a electrical signal that is passed onto electronics package 122 via electrical conductor 126, as will be more fully described with reference to FIG. 5. Electronics package 122 processes and amplifies the electrical signal which is then fed to transmitter 124 via electrical conductor 128, as will be more fully described with reference to FIG. 12. Transmitter 124 transforms the electrical signal into an electromagnetic output signal that is radiated into the earth carrying information.

When repeater 76 serves as acoustic-to-electromagnetic repeater 81 of FIG. 1B, receiver 120 receives an acoustic input signal carrying information which is transformed into a electrical signal that is passed onto electronics package 122 via electrical conductor 126. Electronics package 122 processes and amplifies the electrical signal which is then fed to transmitter 124 via electrical conductor 128. Transmitter 124 transforms the electrical signal into an electromagnetic output signal carrying information that is radiated into the earth.

When repeater 76 serves as electromagnetic-to-acoustic repeater 81 of FIG. 1B, receiver 120 receives an electromagnetic input signal carrying information which is transformed into a electrical signal that is passed onto electronics package 122 via electrical conductor 126, as will be more fully described with reference to FIG. 5. Electronics package 122 processes and amplifies the electrical signal which is then fed to acoustic transmitter 124 via electrical conductor 128. Acoustic transmitter 124 transforms the electrical signal into an acoustic output signal that is transmitted via drill string 30.

Figure 3A:
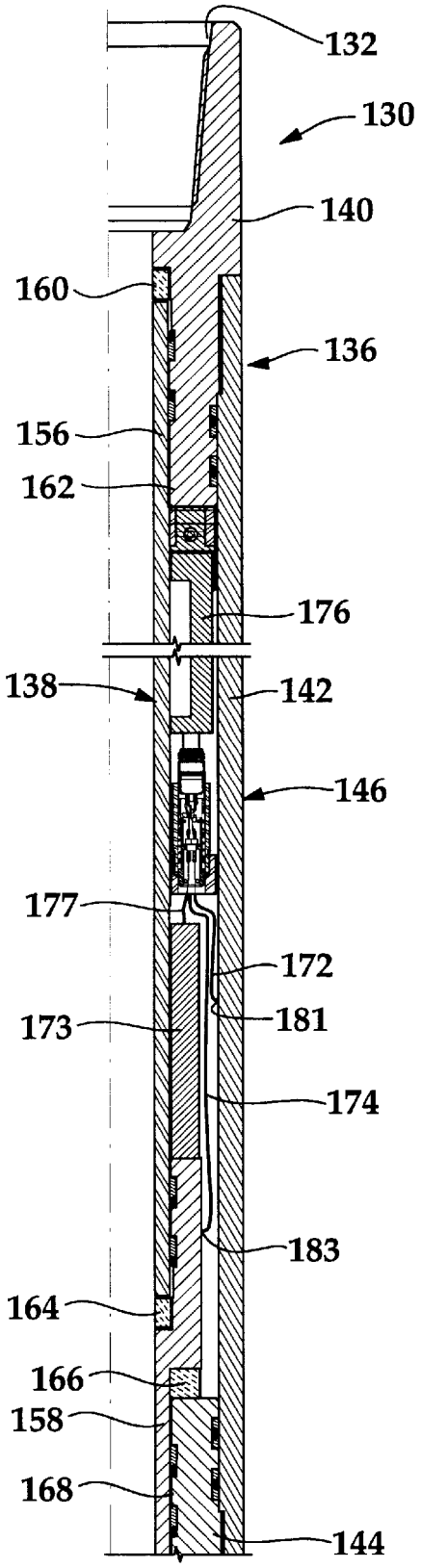
FIGS. 3A–3B are quarter-sectional views of an acoustic-to-electromagnetic repeater of the present invention.
Figure 3B:
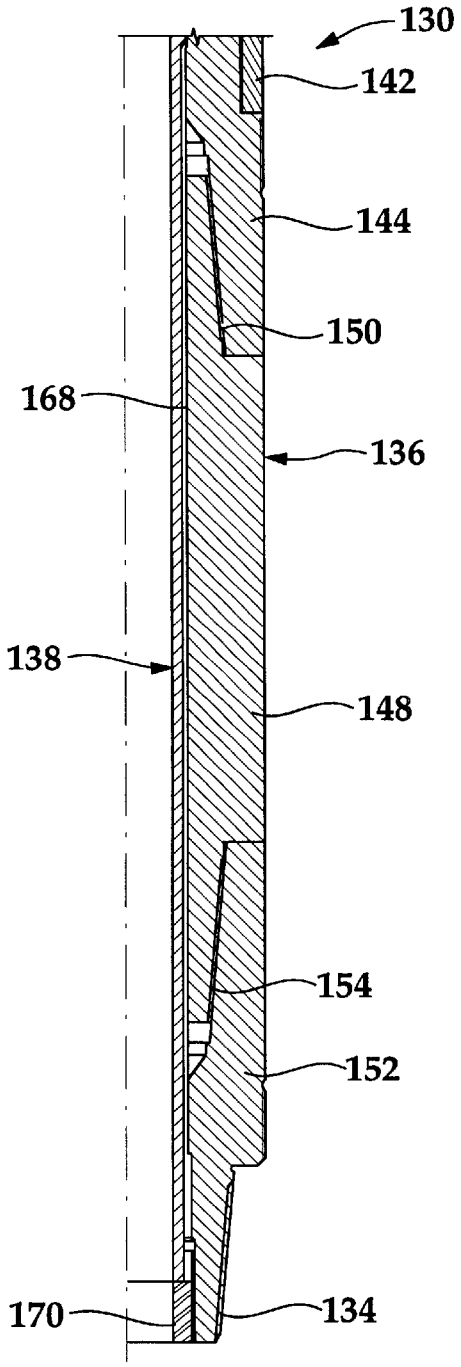

Representatively illustrated in FIGS. 3A–3B is repeater 130 of the present invention depicted in a quarter sectional view for convenience of illustration. Repeater 130 has a box end 132 and a pin end 134 such that repeater 130 is threadably adaptable to drill string 30. Repeater 130 has an outer housing 136 and a mandrel 138 such that repeater 130 may be interconnected with drill string 30 providing a circulation path for fluids therethrough and therearound. Housing 136 and mandrel 138 thereby protect to operable components of repeater 130 from drilling mud or other fluids disposed within wellbore 38 and within drill string 30.

Housing 136 of repeater 130 includes an axially extending and generally tubular upper connecter 140 which has box end 132 formed therein. Upper connecter 140 may be threadably and sealably connected to drill string 30 for conveyance into wellbore 38.

An axially extending generally tubular intermediate housing member 142 is threadably and sealably connected to upper connecter 140. An axially extending generally tubular lower housing member 144 is threadably and sealably connected to intermediate housing member 142. Collectively, upper connecter 140, intermediate housing member 142 and lower housing member 144 form upper subassembly 146. Upper subassembly 146, including upper connecter 140, intermediate housing member 142 and lower housing member 144, is electrically connected to the section of drill string 30 above repeater 130.

An axially extending generally tubular isolation subassembly 148 is securably and sealably coupled to lower housing member 144. Disposed between isolation subassembly 148 and lower housing member 144 is a dielectric layer 150 that provides electric isolation between lower housing member 144 and isolation subassembly 148. Dielectric layer 150 is composed of a dielectric material chosen for its dielectric properties and capably of withstanding compression loads without extruding.

An axially extending generally tubular lower connecter 152 is securably and sealably coupled to isolation subassembly 148. Disposed between lower connecter 152 and isolation subassembly 148 is a dielectric layer 154 that electrically isolates lower connecter 152 from isolation subassembly 148. Lower connecter 152 is adapted to threadably and sealably connect to drill string 30 and is electrically connected to the portion of drill string 30 below repeater 130.

Isolation subassembly 148 provides a discontinuity in the electrical connection between lower connecter 152 and upper subassembly 146 of repeater 130, thereby providing a discontinuity in the electrical connection between the portion of drill string 30 below repeater 130 and the portion of drill string 30 above repeater 130.

Mandrel 138 includes axially extending generally tubular upper mandrel section 156 and axially extending generally tubular lower mandrel section 158. Upper mandrel section 156 is partially disposed and sealing configured within upper connecter 140. A dielectric member 160 electrically isolates upper mandrel section 156 and upper connecter 140. The outer surface of upper mandrel section 156 has a dielectric layer disposed thereon. Dielectric layer 162 may be, for example, a teflon layer. Together, dielectric layer 162 and dielectric member 160 service to electrically isolate upper connecter 140 from upper mandrel section 156.

Between upper mandrel section 156 and lower mandrel section 158 is a dielectric member 164 that, along with dielectric layer 162 serves to electrically isolate upper mandrel section 156 from lower mandrel section 158. Between lower mandrel section 158 and lower housing member 144 is a dielectric member 166. On the outer surface of lower mandrel section 158 is a dielectric layer 168 which, along with dielectric member 166 provide for electric isolation of lower mandrel section 158 with lower housing member 144. Dielectric layer 168 also provides for electric isolation between lower mandrel section 158 and isolation subassembly 148 as well as between lower mandrel section 158 and lower connecter 152. Lower end 170 of lower mandrel section 158 is disposed within lower connecter 152 and is in electrical communication with lower connecter 152. Intermediate housing member 142 of outer housing 136 and upper mandrel section 156 of mandrel 138 define annular area 172. A receiver 173 and an electronics package 176 are disposed within annular area 172.

In operation, receiver 173 receives an acoustic input signal carrying information which is transformed into a electrical signal that is passed onto electronics package 176 via electrical conductor 177. Electronics package 176 generates an output voltage is then applied between intermediate housing member 142 and lower mandrel section 158, which is electrically isolated from intermediate housing member 142 and electrically connected to lower connector 152, via terminal 181 on intermediate housing member 142 and terminal 183 on lower mandrel section 158. The voltage applied between intermediate housing member 142 and lower connector 152 generates the electromagnetic output signal that is radiated into the earth carrying information.

Figure 4:
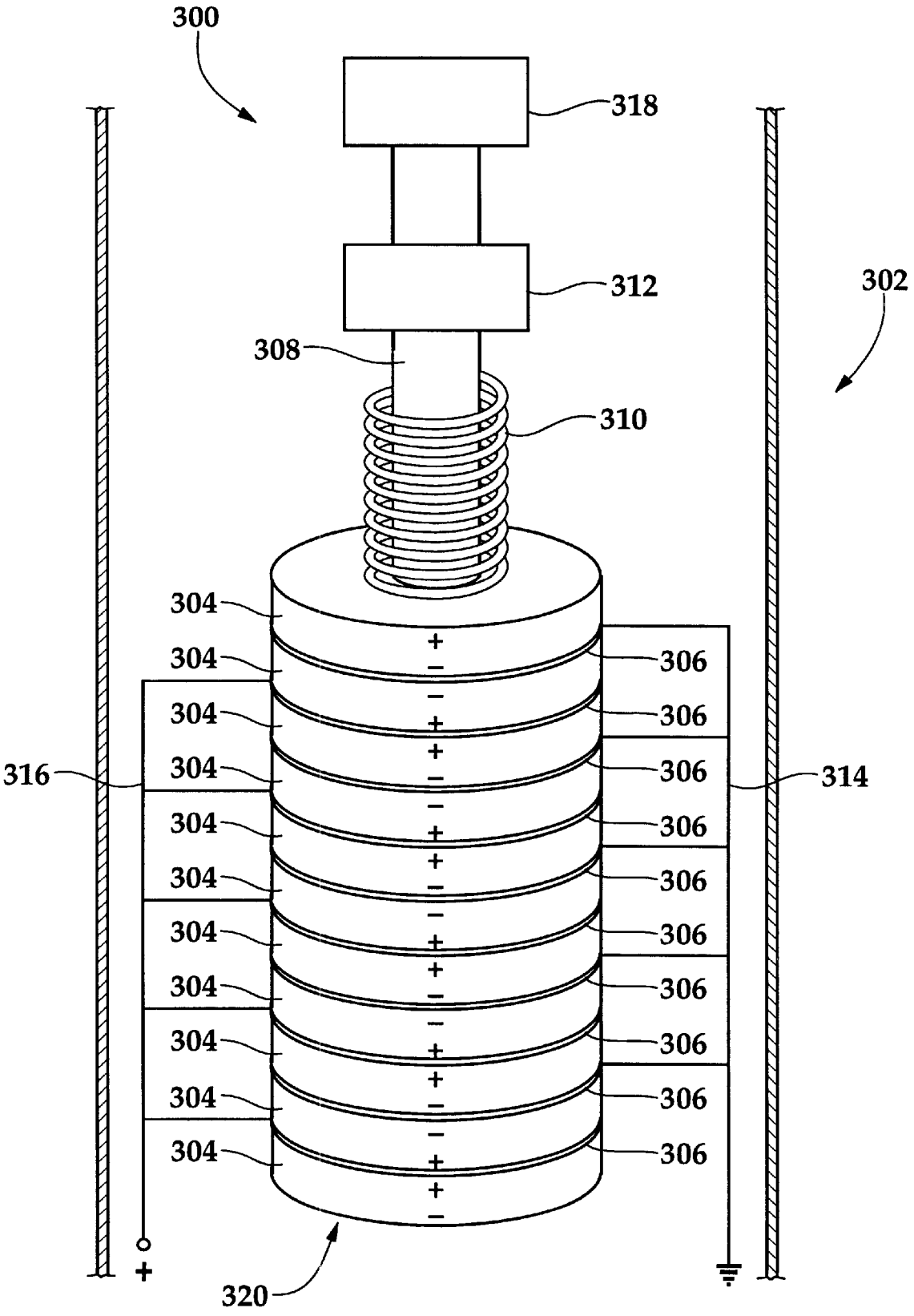
FIG. 4 is an isometric view of an acoustic transmitter or receiver of the present invention.

Referring now to FIG. 4, an acoustic assembly 300 of the present invention is generally illustrated. As should be appreciated by those skilled in the art, acoustic assembly 300 may be generally positioned and deployed, for example, in repeater 76 of FIG. 2A as transmitter 124 or may be generally positioned and deployed in repeater 76 of FIG. 2A as receiver 120. For convenience of description, the following will describe the operation of acoustic assembly 300 as a transmitter. Acoustic assembly 300 includes a generally longitudinal enclosure 302 in which is disposed a stack 320 of piezoelectric ceramic crystal elements 304. The number of piezoelectric elements utilized in the stack 320 may be varied depending upon a number of factors including the particular application, the magnitude of the anticipated signal and the particular materials selected for construction of acoustic assembly 300. As illustrated, piezoelectric crystal elements 304 are positioned on a central shaft 308 and biased with a spring 310. A reaction mass 312 is mounted on the shaft 308. The piezoelectric crystal elements 304 and shaft 308 are coupled to a block assembly 318 for transmission of acoustic signals.

The piezoelectric crystal elements 304 are arranged such is that the crystals are alternately oriented with respect to their direction of polarization within the stack 320. The piezoelectric crystal elements 304 are separated by thin layers of conductive material 306 such as copper so that voltages can be applied to each crystal. Alternating layers 306 are connected to a negative or ground lead 314 and a positive lead 316, respectively. Voltages applied across leads 314 and 316 produce strains in each piezoelectric crystal element 304 that cumulatively result in longitudinal displacement of the stack 320. Displacements of the stack 320 create acoustic vibrations which are transmitted via block assembly 318 to drill string 30 so that the vibrations are transmitted and travel through the various elements of drill string 30.

Acoustic vibrations generated by acoustic assembly 300 travel through the drill string 30 to another acoustic assembly 300 which serves as an acoustic receiver, such as receiver 120. Acoustic assembly 300 then transforms the acoustic vibrations into an electrical signal for processing.

Figure 5:
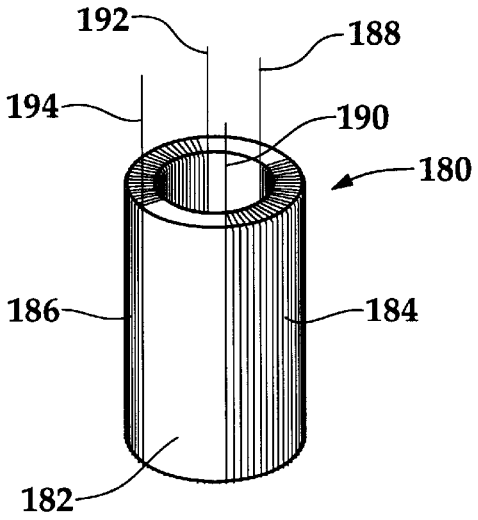
FIG. 5 is a schematic illustration of a toroid having primary and secondary windings wrapped therearound for a repeater of the present invention.

Referring now to FIG. 5, a schematic illustration of a toroid is depicted and generally designated 180. Toroid 180 includes magnetically permeable annular core 182, a plurality of electrical conductor windings 184 and a plurality of electrical conductor windings 186. Windings 184 and windings 186 are each wrapped around annular core 182. Collectively, annular core 182, windings 184 and windings 186 serve to approximate an electrical transformer wherein either windings 184 or windings 186 may serve as the primary or the secondary of the transformer.

In one embodiment, the ratio of primary windings to secondary windings is 2:1. For example, the primary windings may include 100 turns around annular core 182 while the secondary windings may include 50 turns around annular core 182. In another embodiment, the ratio of secondary windings to primary windings is 4:1. For example, primary windings may include 10 turns around annular core 182 while secondary windings may include 40 turns around annular core 182. It will be apparent to those skilled in the art that the ratio of primary windings to secondary windings as well as the specific number of turns around annular core 182 will vary based upon factors such as the diameter and height of annular core 182, the desired voltage, current and frequency characteristics associated with the primary windings and secondary windings and the desired magnetic flux density generated by the primary windings and secondary windings.

Toroid 180 of the present invention may serve as an electromagnetic receiver or an electromagnetic transmitter such as receiver 120 and transmitter 124 of FIG. 2A. Reference will therefore be made to FIG. 2A in further describing toroid 180. Windings 184 of toroid 180 have a first end 188 and a second end 190. First end 188 of windings 184 is electrically connected to electronics package 122. When toroid 180 serves as receiver 120, windings 184 serve as the secondary wherein first end 188 of windings 184 feeds electronics package 122 with an electrical signal via electrical conductor 126. The electrical signal may be processed by electronics package 122 as will be further described with reference to FIGS. 9 and 11 below. When toroid 180 serves as transmitter 124, windings 184 serve as the primary wherein first end 188 of windings 184, receives an electrical signal from electronics package 122 via electrical conductor 128. Second end 190 of windings 184 is electrically connected to upper subassembly 92 of outer housing 82 which serves as a ground.

Windings 186 of toroid 180 have a first end 192 and a second end 194. First end 192 of windings 186 is electrically connected to upper subassembly 92 of outer housing 82. Second end 194 of windings 186 is electrically connected to lower connecter 98 of outer housing 82. First end 192 of windings 186 is thereby separated from second end 192 of windings 186 by isolations subassembly 94 which prevents a short between first end 192 and second end 194 of windings 186.

When toroid 180 serves as receiver 120, electromagnetic wave fronts, such as electromagnetic wave fronts 46 at FIG. 1A, induce a current in windings 186, which serve as the primary. The current induced in windings 186 induces a current in windings 184, the secondary, which feeds electronics package 122 as described above. When toroid 180 serves as transmitter 124, the current supplied from electronics package 122 feeds windings 184, the primary, such that a current is induced in windings 186, the secondary. The current in windings 186 induces an axial current on drill string 30, thereby producing electromagnetic waves.

Due to the ratio of primary windings to secondary windings, when toroid 180 serves as receiver 120, the signal carried by the current induced in the primary windings is increased in the secondary windings. Similarly, when toroid 180 serves as transmitter 124, the current in the primary windings is increased in the secondary windings.

Figure 6:
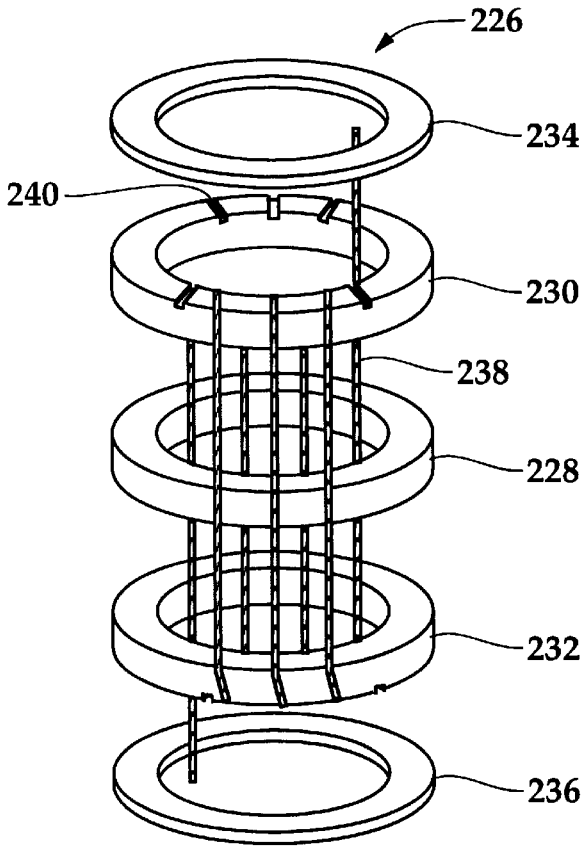
FIG. 6 is an exploded view of one embodiment of a toroid assembly for use as a receiver in a repeater of the present invention.

Referring now to FIG. 6, an exploded view of a toroid assembly 226 is depicted. Toroid assembly 226 may be designed to serve, for example, as receiver 120 of FIG. 2A. Toroid assembly 226 includes a magnetically permeable core 228, an upper winding cap 230, a lower winding cap 232, an upper protective plate 234 and a lower protective plate 236. Winding caps 230, 232 and protective plates 234, 236 are formed from a dielectric material such as fiberglass or phenolic. Windings 238 are wrapped around core 228 and winding caps 230, 232 by inserting windings 238 into a plurality of slots 240 which, along with the dielectric material, prevent electrical shorts between the turns of winding 238. For illustrative purposes, only one set of winding, windings 238, have been depicted. It will be apparent to those skilled in the art that, in operation, a primary and a secondary set of windings will be utilized by toroid assembly 226.

Figure 7:
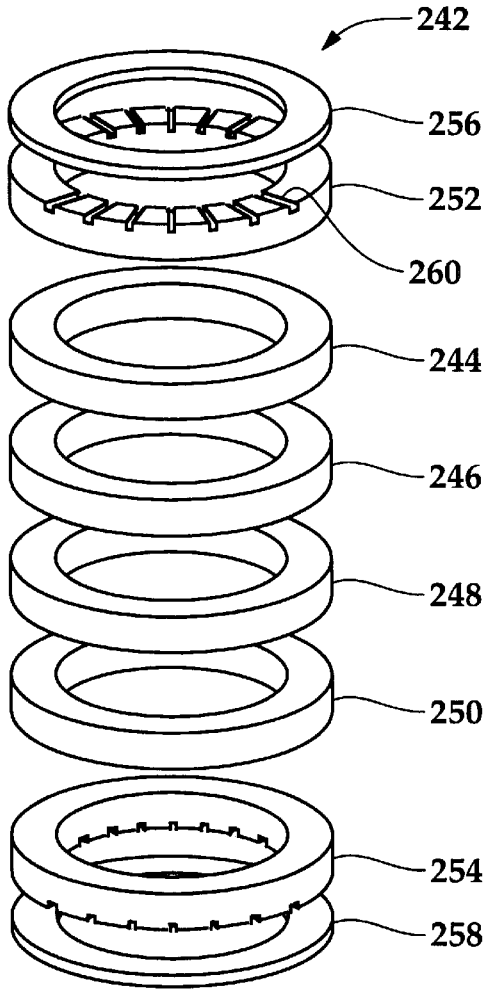
FIG. 7 is an exploded view of one embodiment of a toroid assembly for use as a transmitter in a repeater of the present invention.

FIG. 7 depicts an exploded view of toroid assembly 242 which may serve, for example, as transmitter 124 of FIG. 2A. Toroid assembly 242 includes four magnetically permeable cores 244, 246, 248 and 250 between an upper winding cap 252 and a lower winding cap 254. An upper protective plate 256 and a lower protective plate 258 are disposed respectively above and below upper winding cap 252 and lower winding cap 254. In operation, primary and secondary windings (not pictured) are wrapped around cores 244, 246, 248 and 250 as well as upper winding cap 252 and lower winding cap 254 through a plurality of slots 260.

As is apparent from FIGS. 6 and 7, the number of magnetically permeable cores such as core 228 and cores 244, 246, 248 and 250 may be varied, dependent upon the required length for the toroid as well as whether the toroid serves as a receiver, such as toroid assembly 226, or a transmitter, such as toroid assembly 242. In addition, as will be known by those skilled in the art, the number of cores will be dependent upon the diameter of the cores as well as the desired voltage, current and frequency carried by the primary windings and the secondary windings, such as windings 238.

Figure 8:
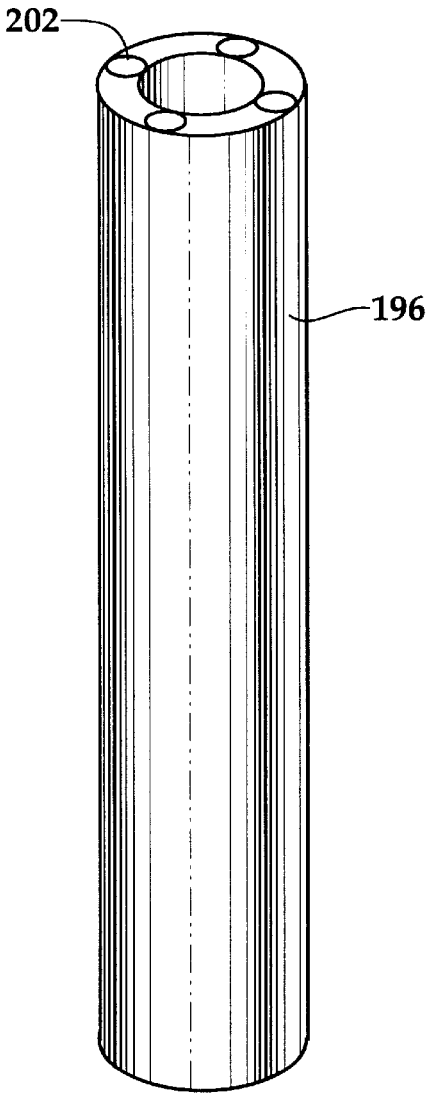
FIG. 8 is a perspective view of an annular carrier of an electronics package for a repeater of the present invention.
Figure 9:
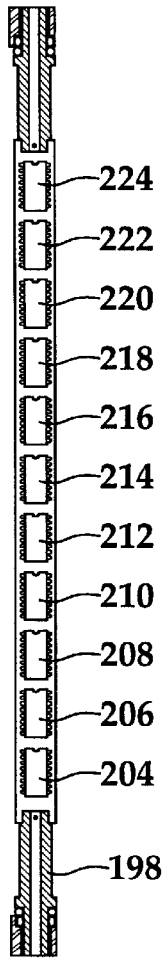
FIG. 9 is a perspective view of an electronics member having a plurality of electronic devices thereon for a repeater of the present invention.
Figure 10:
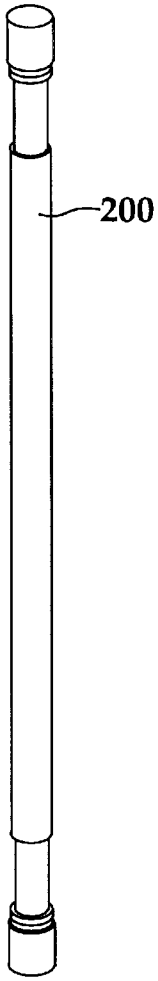
FIG. 10 is a perspective view of a battery pack for a repeater of the present invention.

Turning next to FIGS. 8, 9 and 10 collectively and with reference to FIGS. 2A, therein is depicted the components of electronics package 122 of the present invention. Electronics package 122 includes an annular carrier 196, an electronics member 198 and one or more battery packs 200. Annular carrier 196 is disposed between outer housing 82 and mandrel 84. Annular carrier 196 includes a plurality of axial openings 202 for receiving either electronics member 198 or battery packs 200.

Even though FIG. 8 depicts four axial openings 202, it should be understood by one skilled in the art that the number of axial openings in annular carrier 196 may be varied. Specifically, the number of axial openings 202 will be dependent upon the number of battery packs 200 which will be required for a specific implementation of electromagnetic signal repeater 76 of the present invention.

Electronics member 198 is insertable into an axial opening 202 of annular carrier 196. Electronics member 198 receives an electrical signal from first end 188 of windings 184 when toroid 180 serves as receiver 120. Electronics member 198 includes a plurality of electronic devices such as a preamplifier 204, a limiter 206, an amplifier 208, a notch filter 210, a high pass filter 212, a low pass filter 214, a frequency to voltage converter 216, voltage to frequency converter 218, amplifiers 220, 222, 224. The operation of these electronic devices will be more full discussed with reference to FIG. 11.

Battery packs 200 are insertable into axial openings 202 of axial carrier 196. Battery packs 200, which includes batteries such as nickel cadmium batteries or lithium batteries, are configured to provide the proper operating voltage and current to the electronic devices of electronics member 198 and to, for example, toroid 180.

Even though FIGS. 8–10 have described electronics package 122 with reference to annular carrier 196, it should be understood by one skilled in the art that a variety of configurations may be used for the construction of electronics package 122. For example, electronics package 122 may be positioned concentrically within mandrel 84 using several stabilizers and having a narrow, elongated shape such that a minimum resistance will be created by electronics package 122 to the flow of fluids within drill string 30.

Figure 11:
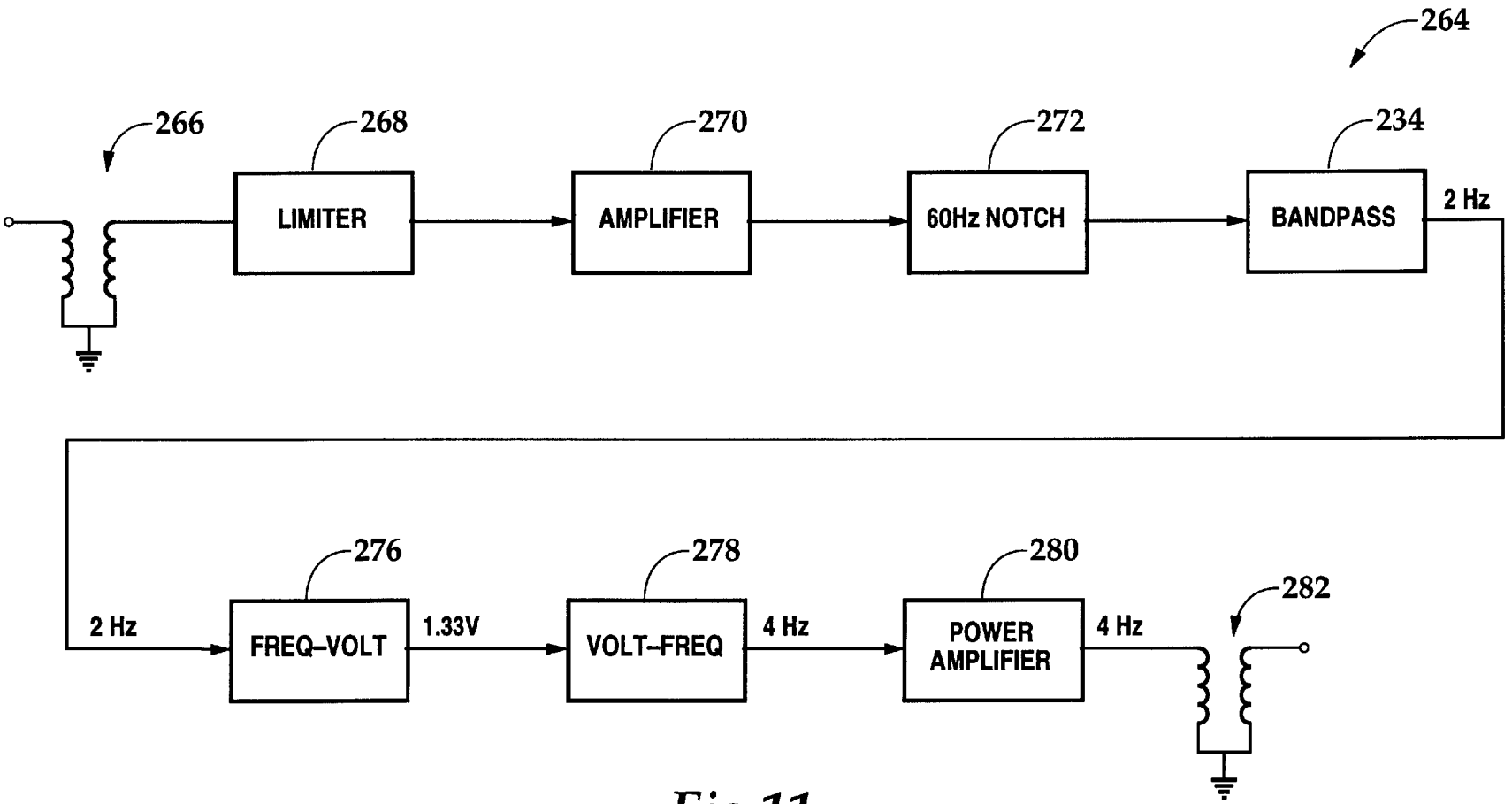
FIG. 11 is a block diagram of a signal processing method of a repeater of the present invention.

FIG. 11 is a block diagram of one embodiment of the method for processing the electrical signal by electronics package 122 which is generally designated 264. The method 264 utilizes a plurality of electronic devices such as those described with reference to FIG. 9. Method 264 is an analog pass through process that does not require modulation or demodulation, storage or other digital processing. Limiter 268 receives an electrical signal from receiver 266. Limiter 268 may include a pair of diodes for attenuating the noise to between about 0.3 and 0.8 volts. The electrical signal is then passed to amplifier 270 which may amplify the electrical signal to 5 volts. The electrical signal is then passed through a notch filter 272 to shunt noise in the 60 hertz range, a typical frequency for noise in an offshore application in the United States whereas a European application may have of 50 hertz notch filter. The electrical signal then enters a band pass filter 234 to attenuate high noise and low noise and to recreate a signal having the original frequency which was electromagnetically transmitted, for example, two hertz.

The electrical signal is then fed to a frequency to voltage converter 276 and a voltage to frequency converter 278 in order to shift the frequency of the electrical signal from, for example, 2 hertz to 4 hertz. This frequency shift allows each repeater to retransmit the information carried in the original electromagnetic signal at a different frequency. The frequency shift prevents multiple repeaters from attempting to interpret stray signals by orienting the repeaters such that each repeater will be looking for a different frequency or by sufficiently spacing repeaters along drill string 30 that are looking for a specific frequency.

After the electrical signal has a frequency shift, power amplifier 280 increases the signal which travels to transmitter 282. Transmitter 282 transforms the electrical signal into an electromagnetic signal which is radiated into the earth to another repeater as its final destination.

While the invention has been described in connection with the appended drawings, the description is not to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments within the spirit and scope of the invention.

What is claimed is:

1. A downhole communication system for alleviating delays in communication between surface equipment and downhole equipment separated by a pipe string, the system comprising:

a first signal repeater disposed within the pipe string including an electromagnetic receiver for receiving an electromagnetic input signal from the earth and transforming the electromagnetic input signal into a first electrical signal and an acoustic transmitter electrically connected to the electromagnetic receiver for transforming the first electrical signal into an acoustic output signal that is transmitted along the pipe string; and a second signal repeater disposed within the pipe string including an acoustic receiver for receiving the acoustic output signal from the pipe string and transforming the acoustic output signal into a second electrical signal and an electromagnetic transmitter electrically connected to the acoustic receiver for transforming the second electrical signal into an electromagnetic output signal that is radiated into the earth.

2. The system as recited in claim 1 wherein the electromagnetic receiver and the electromagnetic transmitter each further comprises a magnetically permeable annular core, a plurality of primary electrical conductor windings wrapped axially around the annular core and a plurality of secondary electrical conductor windings wrapped axially around the annular core and magnetically coupled to the plurality of primary electrical conductor windings.

3. The system as recited in claim 1 further comprising an electronics package electrically connected to the electromagnetic receiver and the acoustic transmitter for amplifying the first electrical signal.

4. The system as recited in claim 1 further comprising an electronics package electrically connected to the acoustic receiver and the electromagnetic transmitter for amplifying the second electrical signal.

5. The system as recited in claim 1 wherein the acoustic transmitter and the acoustic receiver each further comprises a plurality of piezoelectric elements.

6. The system as recited in claim 1 further comprising a third signal repeater including an electromagnetic receiver for receiving the electromagnetic output signal from the earth and transforming the electromagnetic output signal into a third electrical signal and an acoustic transmitter electrically connected to the electromagnetic receiver of the third signal repeater for transforming the third electrical signal to an acoustic output signal that is transmitted along the pipe string.

7. The system as recited in claim 6 further comprising an electronics package electrically connected to the electromagnetic receiver of the third signal repeater and the acoustic transmitter of the third signal repeater for amplifying the third electrical signal.

8. A downhole communication system for alleviating delays in communication between surface equipment and downhole equipment separated by a pipe string, the system comprising:

a first signal repeater disposed within the pipe string including an acoustic receiver for receiving an acoustic input signal from the pipe string and transforming the acoustic input signal into a first electrical signal and an electromagnetic transmitter electrically connected to the acoustic receiver for transforming the first electrical signal into an electromagnetic output signal that is radiated into the earth; and a second signal repeater disposed within the pipe string including an electromagnetic receiver for receiving the electromagnetic output signal from the earth and transforming the electromagnetic output signal into a second electrical signal and an acoustic transmitter electrically connected to the electromagnetic receiver for transforming the second electrical signal into an acoustic output signal that is transmitted along the pipe string.

9. The system as recited in claim 8 wherein the electromagnetic receiver and the electromagnetic transmitter each further comprises a magnetically permeable annular core, a plurality of primary electrical conductor windings wrapped axially around the annular core and a plurality of secondary electrical conductor windings wrapped axially around the annular core and magnetically coupled to the plurality of primary electrical conductor windings.

10. The system as recited in claim 8 further comprising an electronics package electrically connected to the electromagnetic receiver and the acoustic transmitter for amplifying the second electrical signal.

11. The system as recited in claim 8 further comprising an electronics package electrically connected to the acoustic receiver and the electromagnetic transmitter for amplifying the first electrical signal.

12. The system as recited in claim 8 wherein the acoustic transmitter and the acoustic receiver each further comprises a plurality of piezoelectric elements.

13. The system as recited in claim 8 further comprising a third signal repeater including an acoustic receiver for receiving the acoustic output signal from the pipe string and transforming the acoustic output signal to a third electrical signal and an electromagnetic transmitter electrically connected to the acoustic receiver of the third signal repeater for transforming the third electrical signal to an electromagnetic output signal that is radiated into the earth.

14. The system as recited in claim 13 further comprising an electronics package electrically connected to the acoustic receiver of the third signal repeater and the electromagnetic transmitter of the third signal repeater for amplifying the third electrical signal.

15. A method for alleviating delays in communication between surface equipment and downhole equipment separated by a pipe string, the method comprising the steps of:

positioning first and second signal repeaters in the pipe string, the first signal repeater having an electromagnetic receiver and an acoustic transmitter, the second signal repeater having an acoustic receiver and an electromagnetic transmitter;

receiving an electromagnetic input signal from the earth on the electromagnetic receiver;

transforming the electromagnetic input signal into a first electrical signal;

sending the first electrical signal to the acoustic transmitter;

transforming the first electrical signal into an acoustic output signal;

transmitting the acoustic output signal along the pipe string;

receiving the acoustic output signal from the pipe string on the acoustic receiver;

transforming the acoustic output signal into a second electrical signal;

sending the second electrical signal to the electromagnetic transmitter;

transforming the second electrical signal into an electromagnetic output signal; and radiating the electromagnetic output signal into the earth.

16. The method as recited in claim 15 further comprising the steps of sending the first electrical signal to an electronics package and amplifying the first electrical signal.

17. The method as recited in claim 15 further comprising the steps of sending the second electrical signal to an electronics package and amplifying the second electrical signal.

18. A method for alleviating delays in communication between surface equipment and downhole equipment separated by a pipe string, the method comprising the steps of:

positioning first and second signal repeaters in the pipe string, the first signal repeater having an acoustic receiver and an electromagnetic transmitter, the second signal repeater having an electromagnetic receiver and an acoustic transmitter;

receiving an acoustic input signal from the pipe string on the acoustic receiver;

transforming the acoustic input signal into a first electrical signal;

sending the first electrical signal to the electromagnetic transmitter;

transforming the first electrical signal into an electromagnetic output signal;

radiating the electromagnetic output signal into the earth;

receiving the electromagnetic output signal from the earth on the electromagnetic receiver;

transforming the electromagnetic output signal into a second electrical signal;

sending the second electrical signal to the acoustic transmitter;

transforming the second electrical signal into an acoustic output signal; and transmitting the acoustic output signal along the pipe string.

19. The method as recited in claim 18 further comprising the steps of sending the first electrical signal to an electronics package and amplifying the first electrical signal.

20. The method as recited in claim 18 further comprising the steps of sending the second electrical signal to an electronics package and amplifying the second electrical signal.

* * * * *